United States Patent [19]

Reggia et al.

[11] 4,051,480

[45] Sept. 27, 1977

[54] CONFORMAL EDGE-SLOT RADIATORS

[75] Inventors: Frank Reggia, Bethesda, Md.; Howard S. Jones, Jr., Washington, D.C.

[73] Assignee: The United States of America as represented by the Secretary of the Army, Washington, D.C.

[21] Appl. No.: 736,014

[22] Filed: Oct. 27, 1976

[51] Int. Cl.[2] ..... H01Q 1/28

[52] U.S. Cl. ..... 343/705; 343/708; 343/769

[58] Field of Search ..... 343/700 MS, 705, 769, 343/776, 708

[56] References Cited

U.S. PATENT DOCUMENTS

| | | | |
|---|---|---|---|
| 2,486,589 | 11/1949 | Chu | 343/769 |
| 2,973,514 | 2/1961 | Sprague | 343/769 |
| 3,100,892 | 8/1963 | Cutler | 343/776 |

*Primary Examiner*—Alfred E. Smith
*Assistant Examiner*—H. Barlow
*Attorney, Agent, or Firm*—Nathan Edelberg; Robert P. Gibson; Saul Elbaum

[57] ABSTRACT

A dielectric loaded edge-slot radiator whose exterior dimensions are adjustable to allow flush mounting on cylindrical and conical bodies which can be frequency tuned either electrically or mechanically. This is done by varying the number of inductive posts which are used as boundaries for the individual elements making up the antenna. A single inductive probe whose characteristic impedance is matched to the rf source is coupled so as to simultaneously excite all of the radiating elements in phase. The radiation field produced in a plane containing the radiator is nearly of constant amplitude.

8 Claims, 10 Drawing Figures

CONFORMAL EDGE-SLOT RADIATORS

RIGHTS OF THE GOVERNMENT

This invention described herein may be manufactured, used, and licensed by or for the United States for governmental purposes without the payment to us of any royalty thereon.

BACKGROUND OF THE INVENTION

This invention is in the field of VHF, UHF, and microwave antennas, or more specifically it is related to small conformal antennas which are frequency tuned both electrically and mechanically without changing the physical dimensions of the antenna.

For many applications the versatility of an antenna is of great importance, especially when being utilized in research and development situations. In certain instances they must be adjusted to allow flush-mounting on cylindrical or conical surfaces. Often they must be modified to conform with more complex surfaces such as aircraft or reentry vehicles. One problem often associated with these requisites is that of being able to frequency tune such an antenna without changing its physical dimensions.

The present invention satisfies all these requirements with an antenna which is additionally characterized by small size, lightweight and sufficient operating bandwidth for most applications. Furthermore, it is rather easily fabricated at low cost.

It is therefore one object of this invention to provide a radiator whose exterior dimensions are adjustable to allow flush mounting.

It is another object of this invention to provide an antenna which can be frequency tuned both electrically and mechanically without changing the physical dimensions of the antenna.

It is a further object of this invention to provide a conformal antenna with sufficient operating bandwidth at a relatively low cost.

It is still another object of this invention to provide an antenna which can exhibit nearly a constant amplitude in its radiating field in a plane containing the radiator.

It is still a further object of this invention to provide a single conformal antenna which is of small size and lightweight, yet can be frequency tuned over at least a 7:1 frequency range.

SUMMARY OF THE INVENTION

These and other objects, features, and advantages of the invention are accomplished by a new type of conformal antenna which is essentially a dielectric loaded edge-slot radiator whose exterior dimensions have been adjusted to allow flush-mounting on projectiles or more complex surfaces. The radiating element can be mechanically tuned by varying the number of inductive posts used as boundaries for individual elements making up the edge-slot antenna. Any number of these radiators can be easily placed along the contours of a projectile or vehicular surface to obtain a high gain antenna system.

BRIEF DESCRIPTION OF THE DRAWINGS

The above and further objects and novel features of the invention will more fully appear from the following description when the same is read in connection with the accompanying drawings. It is to be understood, however, that the drawings are for the purpose of illustration only, and are not intended as a definition of the limits of the invention.

DESCRIPTION OF THE PREFERRED EMBODIMENT

Figure 1:
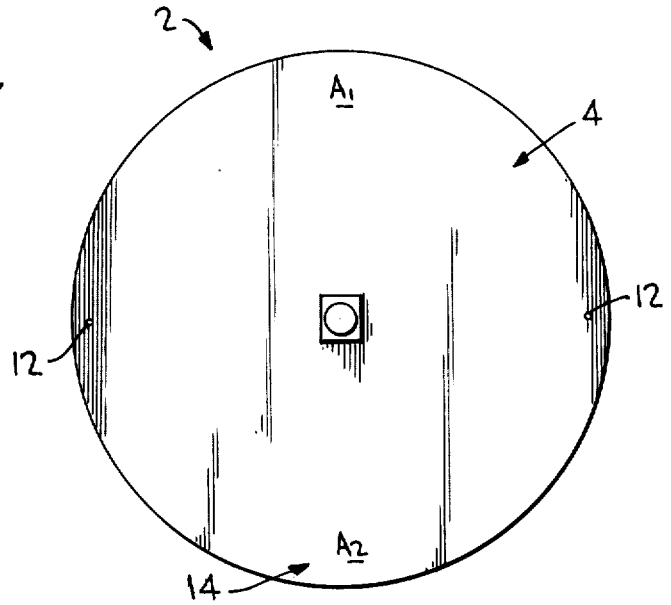
FIG. 1 illustrates schematically a top view of a dual-element edge-slot radiator.
Figure 1A:
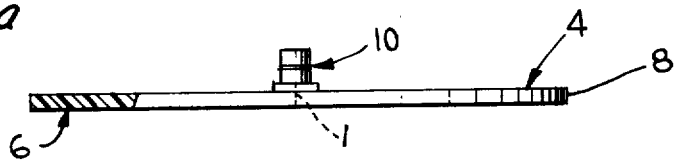
FIG. 1*a* illustrates schematically a side view of the same dual-element edge-slot radiator.

FIGS. 1 and 1*a* illustrate just one of a number of possible embodiments which can be conceived by practicing this invention. Generally, these small conformal antennas 2 are dielectrically loaded edge-slot radiators whose basic substrate 8 (FIG. 1*a*) is of a Teflon-fiberglass or similar material. The substrate 8 is metal clad, usually by copper plating both upper 4 and lower 6 surfaces. Plated-through holes (inductive posts) 12 are used as the boundry for the individual elements making up the edge-slot radiator. A single inductive probe 10, matched to the characteristic impedance of the rf source, is placed at the center of the disc 2 to simultaneously excite all the radiating elements 14 in-phase. The inner conductor 1 of probe 10 passes through substrate 8 and is shorted to opposite surface 6 of the disc.

The versatility of this invention is exhibited by the way it can be frequency tuned by varying the number of inductive shorting posts 12 used as boundaries for the radiators without requiring any change in the external dimensions. This method of tuning has already been used successfully over the entire frequency range from 200 MHz to 8000 Mhz in just about every configuration possible with a projectile body and is frequency tunable over a 7:1 frequency range without changing the physical dimensions of the antenna.

Figure 2:
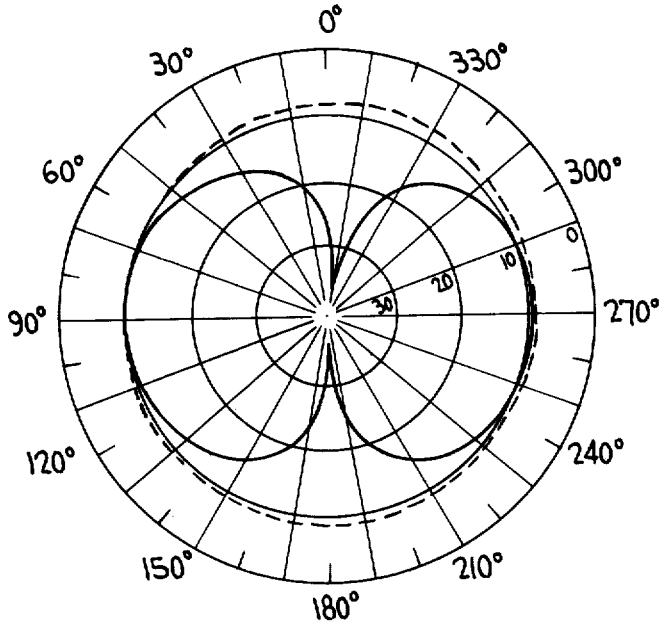
FIG. 2 illustrates graphically a typical far field radiation pattern obtained at 228 MHz for a dual-element edge-slot radiator at the center of an 8-inch diameter cylindrical body shown as FIG. 2*a*.
Figure 2A:
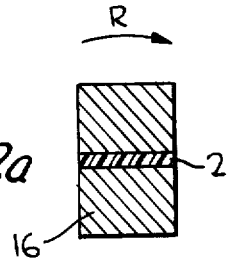
FIG. 2*a* illustrates schematically the configuration from which the radiator pattern of FIG. 2 was taken.

Returning to the specific embodiment of FIG. 1 it is seen that this device is composed of 2 radiating elenents 14, A1, and A2 and only two boundary lines 12 of one hole each, which is more or less a limiting case. The disc diameter of this embodiment was made to measure 8 inches, and when placed in the center of 2 cylindrical casings 16 of the same diameter and of 8 inches in length (FIG. 2*a*) the radiation patterns of FIG. 2 are observable. The illustrated radiation pattern, taken at a minimum frequency of 228 MHz, exhibits a unique characteristic of this antenna, a nearly constant amplitude of the radiation field (broken line) in the plane containing the disc radiator (azimuthal pattern). (Elevation patterns are illustrated as solid lines).

Figure 3:
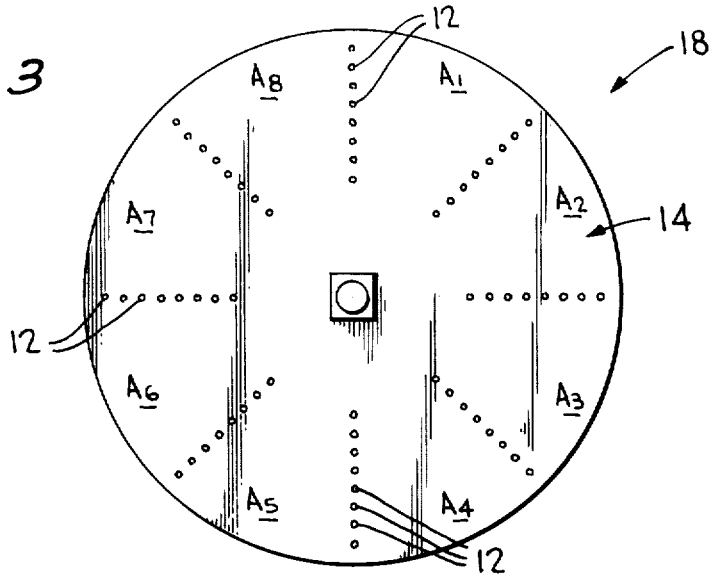
FIG. 3 illustrates schematically a top view of an 8-element edge-slot antenna.
Figure 4:
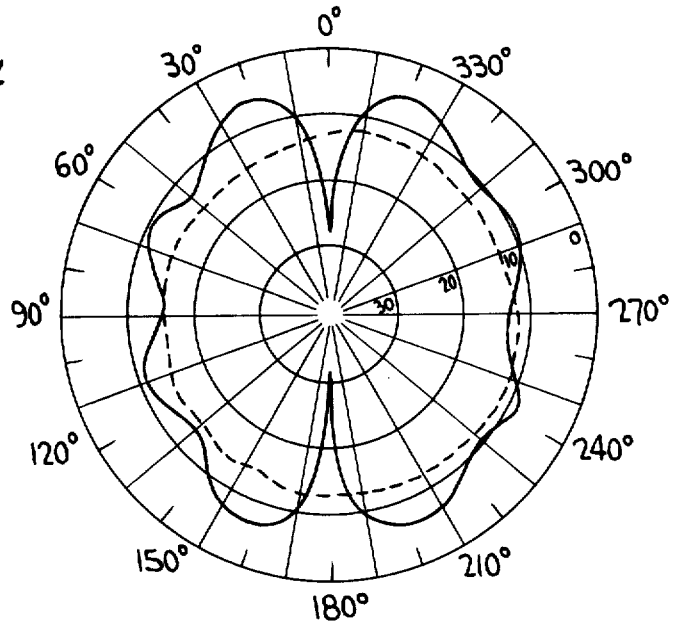
FIG. 4 illustrates graphically the far-field radiation pattern obtained at 2315 MHz for an 8-element disc antenna at the center of a 5 5/16 inch diameter cylindrical body which is 10⅞ inches long.

Another embodiment designed to be operated at a higher frequency is illustrated schematically in FIG. 3. (Elements corresponding to FIG. 1 are numbered the same). Structurally this 8 element disc antenna 18 is very similar to the radiator of FIG. 1 except for the number of inductive shorting posts 12 appearing over the surface of the disc. As observed in FIG. 3 it is seen that this device is composed of 8 radiating elements 14, A1, through A8, and 8 radial lines of inductive posts 12 containing 8 holes each. The disc diameter utilized in one performance test measured approximately 5 5/16 inches in diameter with a thickness of ⅛ inch. The radiation pattern at a frequency of 2315 MHz for this antenna is illustrated graphically in FIG. 4 for when it was placed at the center of cylindrical body of the same diameter and approximately 10⅞ inches in length (configuration similar to FIG. 2*a*). Again the radiation field (broken line circle) in the plane containing the disc radiator is nearly constant, and the elevation pattern (solid line) is not as directional as that observed for the dual element edge-slot antenna.

Figure 5:
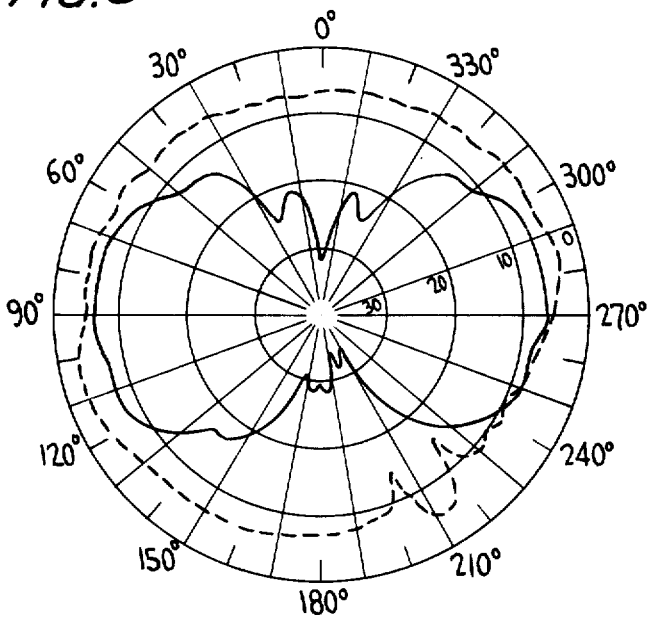
FIG. 5 illustrates graphically the far-field radiation pattern at 8300 MHz for two edge-slot radiators spaced a half wavelength apart and excited in-phase on a 40 mm projectile shown as FIG. 5*a*.
Figure 5A:
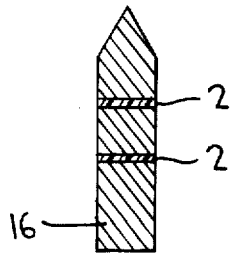
FIG. 5*a* illustrates schematically the configuration from which the radiation pattern of FIG. 5 was taken.

In order to obtain a high gain antenna system any number of these slot-radiators can be easily placed along the cylindrical body of a projectile as illustrated in FIG. 5*a* for dual radiators on a 40 mm projectile. The disc antennas 2 in this case are spaced a half wavelength apart, and each antenna contained 8 elements with between 2 and 3 inductive shortings posts forming the boundary between the elements. At 8300 MHz this system exhibits high gain characteristics out the side of the projectile (elevation pattern — solid curve of FIG. 5).

Figure 6:
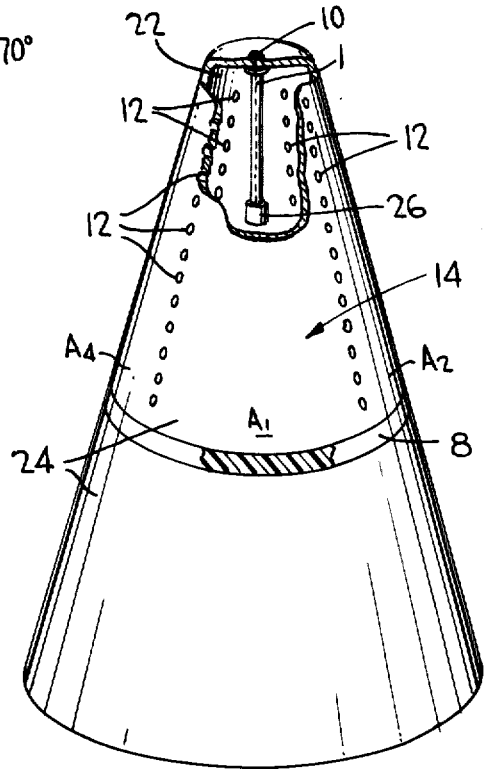
FIG. 6 illustrates schematically a conically shaped 4-element edge-slot radiator.
Figure 7:
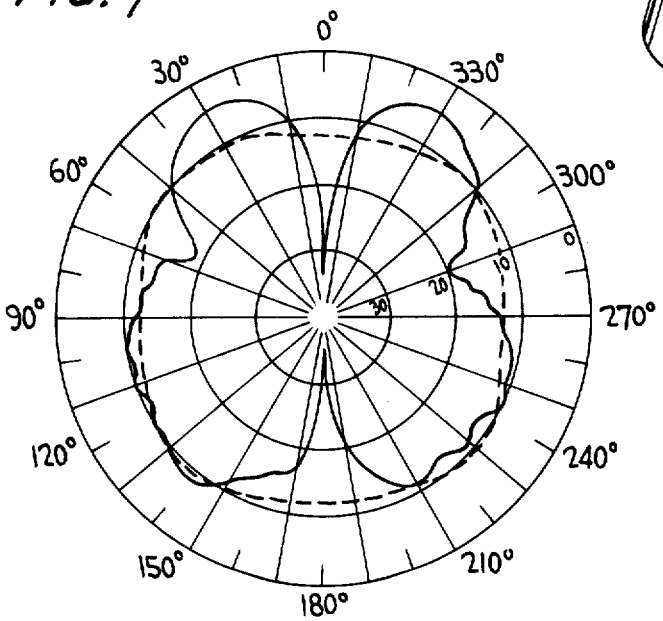
FIG. 7 illustrates graphically the far-field radiation pattern at 6330 MHz for the conically shaped edge-slot radiator illustrated in FIG. 6.

The planar type of edge-slot radiators described above can be easily modified to satisfy other system needs. One example of this is the conical shaped model in the cutaway schematic of FIG. 6. (Comparative elements are correspondingly numbered). This specific embodiment is of the 4-element variety with 13 inductive shorting posts used between each of the 4 elements making up this antenna. Both inside 22 and outside 24 surfaces are generally copper plated. Packaging of the electronic circuitry inside the conical structure without interference to radiation field and easy access for the coaxial input feed 26 and input probe 10 are advantageous characteristics of this antenna design. Similarly to FIG. 1*a* the inner conductor of coaxial input 26 and probe 10 passes through substrate 8 and is shorted to outside surface 24 of the antenna. The radiation patterns for this version of the edge-slot antenna concept at 6330 MHz and with a base diameter of 2 inches, a top diameter of ⅝ inches, and a height of 3 inches and whose slot is approximately placed 1⅝ inches vertically from the top is illustrated graphically on FIG. 7.

The concept exhibited by the aforementioned embodiments can be a valuable tool in antenna design. Simply by increasing the number of inductive posts one can raise the operating frequency of the antenna without changing its physical dimensions, the number of inductive posts or radiating elements not deleteriously affecting the constant phase front nature of this antenna. Although several embodiments of this invention have been illustrated in the accompanying drawings and foregoing specification, it should be understood by those skilled in the art that various changes such as relative dimensions, numbers of antennas, configuraton, and materials used, and the like, as well as the suggested manner of the use of invention, may be made therein without departing from the spirit and scope of the invention.

What we claim is:

1. A dielectric loaded edge-slot radiator whose exterior dimensions can be chosen to allow flush-mounting on cylindrical and conical bodies comprising:

a dielectric substrate having a plurality of holes uniformly positioned in radial lines over the substrate;

a conductive plating disposed on the surfaces of the substrate acting as radiating elements;

a coupling means for exciting the radiating elements, and a plurality of inductive shorting posts conformal to the holes in the substrate, whereby the edge-slot radiator can be frequency tuned without changing the physical dimensions of the antenna.

2. The radiator as set forth in claim 1 wherein the dielectric substrate has its holes aligned such that they act as a boundary for individual elements making up the edge-slot radiator.

3. The radiator as set forth in claim 1 wherein the coupling means comprises a single inductive probe matched to the characteristic impedance of the rf source and is positioned at the propagation center of the edge-slot radiator to excite all the elements in-phase.

4. The radiator as set forth in claim 3 wherein the substrate and plating are in form of a disc.

5. The radiator as set forth in claim 3 wherein the substrate and plating are conically shaped.

6. The radiator as set forth in claim 3 wherein the substrate is of a teflon fiberglass material.

7. The radiator as set forth in claim 6 wherein the teflon fiberglass material is copper cladded.

8. The radiator as set forth in claim 3 wherein the thickness of the substrate is approximately ⅛ inch.

* * * * *